US012753566B2

(12) United States Patent
Hockema

(10) Patent No.: US 12,753,566 B2
(45) Date of Patent: Oct. 6, 2026

(54) MODULAR PIT FRAME

(71) Applicant: The Ford Meter Box Company, Inc., Wabash, IN (US)

(72) Inventor: Steven W. Hockema, Columbia City, IN (US)

(73) Assignee: The Ford Meter Box Company, Inc., Wabash, IN (US)

( * ) Notice: Subject to any disclaimer, the term of this patent is extended or adjusted under 35 U.S.C. 154(b) by 0 days.

(21) Appl. No.: 18/977,413

(22) Filed: Dec. 11, 2024

(65) Prior Publication Data

US 2025/0188699 A1 Jun. 12, 2025

Related U.S. Application Data

(60) Provisional application No. 63/609,044, filed on Dec. 12, 2023.

(51) Int. Cl.
*E02D 29/14* (2006.01)

(52) U.S. Cl.
CPC ..... *E02D 29/14* (2013.01)

(58) Field of Classification Search
CPC . E02D 29/14; E03F 5/0401; E03F 2005/0413
See application file for complete search history.

(56) References Cited

U.S. PATENT DOCUMENTS 3,308,727 A * 3/1967 Hurt, Jr. ..... E02D 29/14 277/645
5,240,346 A * 8/1993 Yin ..... E02D 29/149 404/25
5,318,376 A * 6/1994 Prescott, Sr. ..... E02D 29/1409 404/26
5,797,221 A * 8/1998 Young ..... E02D 29/14 52/21
6,161,984 A * 12/2000 Sinclair ..... E02D 29/1427 404/25
9,011,035 B2 * 4/2015 Munro ..... E02D 29/1409 404/26
10,240,317 B2 * 3/2019 Emanuel ..... E02D 29/1445
(Continued)

OTHER PUBLICATIONS

IStatement of Admitted Prior Art executed by Mr. Hockema at The Ford Meter Box Company, Inc. on Mar. 14, 2025.
(Continued)

*Primary Examiner* — Benjamin F Fiorello
(74) *Attorney, Agent, or Firm* — Barnes & Thornburg LLP

(57) ABSTRACT

A modular pit frame is provided. The modular pit frame is configured to receive a lid which fits over a tile and has one of a plurality of lid types. This modular pit frame also includes a riser having an opening bordered by a modular rim that includes a plurality of rim sections. Each of the plurality of rim sections is configured to accommodate a lid type of the plurality of lid types. The plurality of rim sections also includes a first rim section, a second rim section, and a third rim section. The first rim section includes a first rim wall that depends into the opening and forms a first portion of a periphery of the opening. The second rim section includes a second rim wall that depends into the opening and forms a second portion of the periphery of the opening. The second rim wall depends further into the opening than the first rim wall.

20 Claims, 13 Drawing Sheets

(56) References Cited

U.S. PATENT DOCUMENTS

| | | | | |
|---|---|---|---|---|
| 2007/0137114 | A1* | 6/2007 | He | E02D 29/1427 52/20 |
| 2007/0283818 | A1* | 12/2007 | Hockema | E02D 29/1409 220/912 |
| 2008/0196316 | A1* | 8/2008 | Choi | E02D 29/14 49/465 |
| 2020/0270837 | A1* | 8/2020 | Vandersyde | E02D 29/14 |
| 2022/0298772 | A1* | 9/2022 | Young | E03F 5/041 |

OTHER PUBLICATIONS

Mueller frame part No. 700098, Mar. 14, 2025.
Mueller Lid Frame Part No. 700097 and 700098, Mar. 14, 2025.

* cited by examiner

MODULAR PIT FRAME

RELATED APPLICATIONS

The present application relates to and claims priority to U.S. Provisional Patent Application, Ser. No. 63/609,044, filed on Dec. 12, 2023, entitled "Modular Pit Frame." The subject matter disclosed in that Provisional application is hereby expressly incorporated in its entirety into the current Application.

TECHNICAL FIELD AND SUMMARY

The present disclosure relates to meter pit or tile frames, and particularly to frames that accommodate differently configured lids, as well as different pit or tile diameters.

Vertically oriented pits or titles are a common staple of the waterworks industry. Such titles are buried vertically in the ground and house structures, including meters and couplings, for example. A frame, sized to accommodate the diameter of the tile, is placed on top of the tile to provide a top edge that dirt, concrete, or other material can be placed around. The frame also supports a lid that is removably attached to the frame to provide selective access into the tile.

These lids, however, are known to come in a variety of configurations composed of different materials having different locking or latching mechanisms. This requires differently configured frames to accommodate them. For example, some lids are made of plastic while others are made of cast-iron. The cast-iron lids are typically thinner than plastic lids. Furthermore, different lids may use different locking mechanisms, such as a spring lock, rotating lock, or worm lock. The spring lock biases a pin under a rim in the frame to keep the lid secured thereto until the pin is moved from the rim. The rotating latch employs a rotating pin that extends through the lid to rotate an arm that is engageable and disengageable with a portion of the rim on the frame. The worm lock also employs a rotating pin, but this pin is attached to a worm fastener that rotates same to engage with or disengage from a portion of the rim. All of these locking mechanisms rely in some way on engagement with an interior rim of the frame for locking and unlocking. Consequently, these different types of lids, with different types of locks, each require a different frame having a different rim configuration.

In addition to the different lid configurations, tiles can also have any variety of diameters, including 15, 18, 20, 21, 24, 27, 30, and 36 inches, for example. In order to accommodate these different tile sizes, different sized frames are made. One frame design is made to accommodate a lid of particular diameter and lock configuration while a different frame is designed to accommodate another. It is, therefore, commonplace to have several different frames at the ready to accommodate the multitude of tile or lid designs.

In an illustrative embodiment, a modular frame is provided, composed of a riser and a collar that extends from the riser. The riser supports the lid while the collar is supported by the top edge of the pit or title. A modular rim configuration is placed about the inner periphery of the riser in order to accommodate different lid types. The underside of the collar may include one or more rings. Each ring is spaced apart from the other to create a channel or spacing for tiles of different diameters to fit within.

Another illustrative embodiment of the present disclosure provides a modular pit frame. The modular pit frame is configured to receive a lid. The lid fits over a tile and has one of a plurality of lid types. The modular pit frame includes a riser and a collar extending from the riser. The riser includes a central circular opening bordered by a modular rim that includes a plurality of rim sections. Each of the plurality of rim sections is configured to accommodate a lid type of the plurality of lid types. The collar is configured to be supported by the tile. The plurality of rim sections includes a first rim section, a second rim section, and a third rim section. The first rim section includes a first rim wall that depends into the central circular opening and forms a first portion of a periphery of the central circular opening. The first rim section includes a first rim edge that extends transverse to the first rim wall into the central circular opening. The second rim section includes a second rim wall that depends into the central circular opening and forms a second portion of the periphery of the central circular opening. The second rim wall depends further into the central circular opening than the first rim wall. The second rim section includes a second rim edge that extends transverse to the second rim wall into the central circular opening. The third rim section includes a third rim wall that depends into the central circular opening and forms a third portion of the periphery of the central circular opening. The third rim wall depends further into the central circular opening than the first rim wall and the second rim wall. The third rim section includes a third rim edge that extends transverse to the third rim wall into the central circular opening. A first transition surface is located adjacent the first rim section and the second rim section. And a second transition surface is located adjacent the second rim section and the third rim section.

In the above and other illustrative embodiments, the modular pit frame may further comprise: the first transition surface is oriented transverse to the second rim section; the second transition surface is oriented transverse the third rim section; the first rim wall of the first rim section extends around an entire circumference of the central circular opening; a fourth rim section that includes a fourth rim wall that depends into the central circular opening and forms a fourth portion of the periphery of the central circular opening, wherein the fourth rim wall depends further into the central circular opening than the first rim wall, and wherein the fourth rim section includes a fourth rim edge that extends transverse to the fourth rim wall into the central circular opening; a fifth rim section that includes a fifth rim wall that depends into the central circular opening and forms a fifth portion of the periphery of the central circular opening, wherein the fifth rim wall depends further into the central circular opening than the fourth rim wall, and wherein the fifth rim section includes a fifth rim edge that extends transverse to the fifth rim wall into the central circular opening; the fourth rim section is located on the collar opposite the second rim section; the fifth rim section is located on the collar opposite the third rim section; the first rim wall of the first rim section extends around an entire circumference of the central circular opening, which includes between the second rim section and the fifth rim section, as well as the third rim section and forth rim section; the second rim section is located adjacent the third rim section and the fourth rim section is located adjacent the fifth rim section; a first indicia located adjacent the first rim section, a second indicia located adjacent the second rim section, and a third indicia located adjacent the third rim section; one or more braces extending between the riser and the collar; a third transition surface located adjacent the third rim section and the first rim section; at least one guide ring located on an underside of the riser opposite the collar, wherein the at least one guide ring is configured to be located adjacent a top edge of the tile; and a plurality of guide rings spaced apart from each other, wherein each of the plurality of guide rings is located on an underside of the riser opposite the collar.

A further illustrative embodiment of the present disclosure also provides a modular pit frame. The modular pit frame is configured to receive a lid. The lid fits over a tile and has one of a plurality of lid types. This modular pit frame also includes a riser and a collar extending from the riser, wherein the collar is configured to be supported by the tile. This riser includes an opening bordered by a modular rim that includes a plurality of rim sections. Each of the plurality of rim sections is configured to accommodate a lid type of the plurality of lid types. The plurality of rim sections includes a first rim section, a second rim section, and a third rim section. The first rim section includes a first rim wall that depends into the opening and forms a first portion of a periphery of the opening. The second rim section includes a second rim wall that depends into the opening and forms a second portion of the periphery of the opening. The second rim wall depends further into the opening than the first rim wall. The third rim section includes a third rim wall that depends into the opening and forms a third portion of the periphery of the opening. The third rim wall also depends further into the opening than the first rim wall and the second rim wall.

In the above and other illustrative embodiments, the modular pit frame may further comprise: the opening of the riser being circular; the first rim section including a first rim edge that extends transverse to the first rim wall into the opening, the second rim section including a second rim edge that extends transverse to the second rim wall into the opening, and the third rim section including a third rim edge that extends transverse to the third rim wall into the opening; a first transition surface located adjacent the first rim section and the second rim section and a second transition surface located adjacent the second rim section and the third rim section.

A still further illustrative embodiment of the present disclosure also provides a modular pit frame. The modular pit frame is configured to receive a lid. The lid fits over a tile and has one of a plurality of lid types. This modular pit frame also includes a riser. The riser includes an opening bordered by a modular rim that includes a plurality of rim sections. Each of the plurality of rim sections is configured to accommodate a lid type of the plurality of lid types. The plurality of rim sections also includes a first rim section, a second rim section, and a third rim section. The first rim section includes a first rim wall that depends into the opening and forms a first portion of a periphery of the opening. The second rim section includes a second rim wall that depends into the opening and forms a second portion of the periphery of the opening. The second rim wall depends further into the opening than the first rim wall.

Additional features and advantages of the modular pit frame will become apparent to those skilled in the art upon consideration of the following detailed descriptions of carrying out this modular pit frame as presently perceived.

BRIEF DESCRIPTION OF THE DRAWINGS

The concepts described in the present disclosure are illustrated by way of example and not by way of limitation in the accompanying figures. For simplicity, and clarity of illustration, elements illustrated in the figures are not necessarily drawn to scale. For example, the dimensions of some elements may be exaggerated relative to other elements for clarity. Further, where considered appropriate, reference labels may be repeated among the figures to indicate corresponding or analogous elements.

Corresponding reference characters indicate corresponding parts throughout the several views. The exemplification set out herein illustrates embodiments of the modular pit frame and such exemplification is not to be construed as limiting the scope of the modular pit frame in any manner.

DETAILED DESCRIPTION OF THE DRAWINGS

Figure 1:
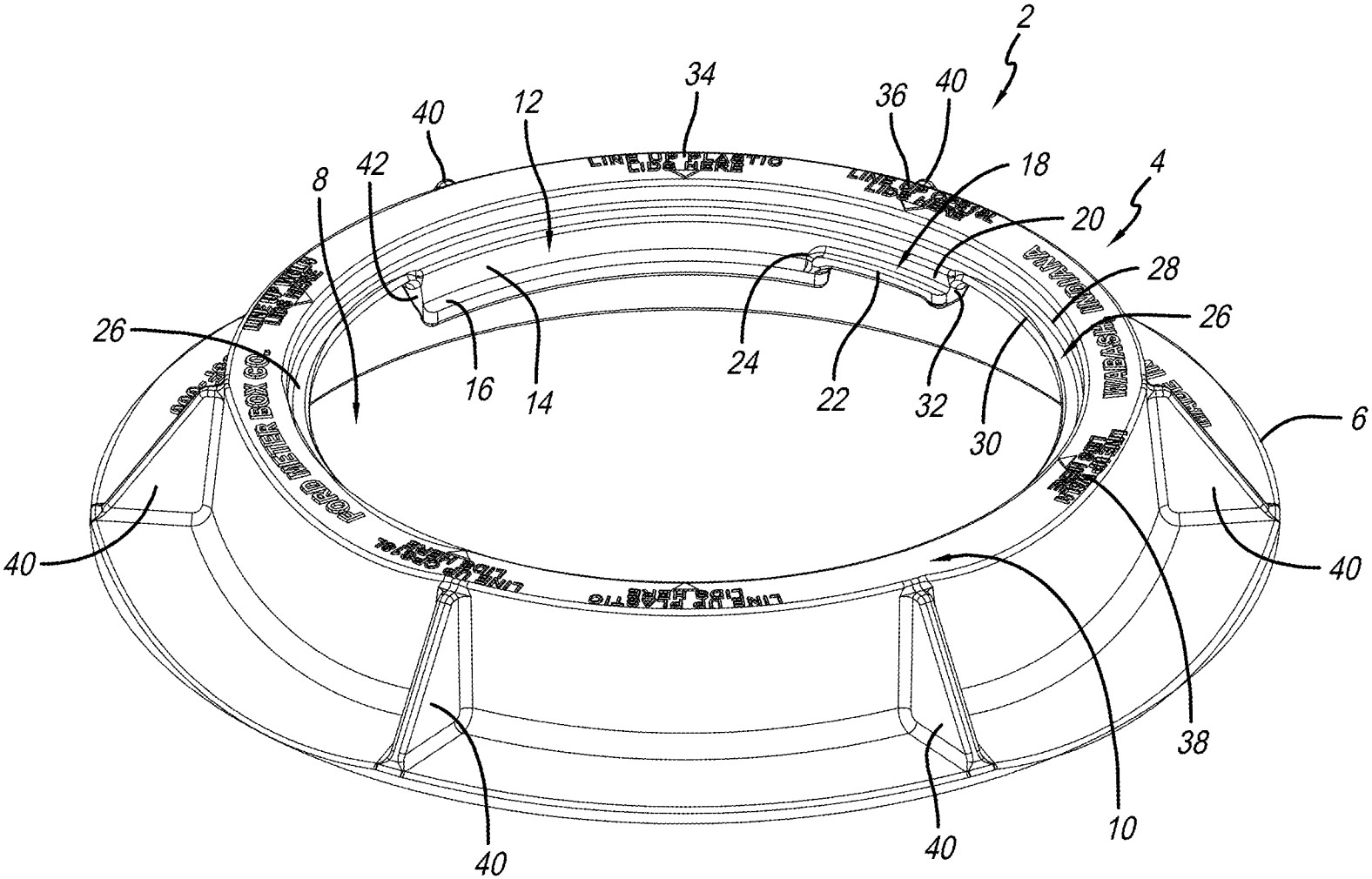
FIG. 1 is a perspective view of a modular pit frame.

The figures and descriptions provided herein may have been simplified to illustrate aspects that are relevant for a clear understanding of the herein described devices, systems, and methods, while eliminating, for the purpose of clarity, other aspects that may be found in typical devices, systems, and methods. Those of ordinary skill may recognize that other elements and/or operations may be desirable and/or necessary to implement the devices, systems, and methods described herein. Because such elements and operations are well known in the art, and because they do not facilitate a better understanding of the present disclosure, a discussion of such elements and operations may not be provided herein. However, the present disclosure is deemed to inherently include all such elements, variations, and modifications to the described aspects that would be known to those of ordinary skill in the art.

In an illustrative embodiment, a modular pit frame is provided that is composed of a riser and a collar that extends from the riser. The riser supports the lid while the collar is supported by the top edge of the pit or title. A modular rim configuration is placed about the inner periphery of the riser in order to accommodate different lid types. The underside of the collar includes one or more rings. Each ring is spaced apart from the other to create a channel or spacing for tiles of different diameters.

The riser extends tangentially from the inner periphery of the collar which allows lids having different depths to still be secured to the modular frame. The modular rim in the collar, likewise, has different depths in order to accommodate lids having different locking mechanisms.

Illustratively, the modular rim may include a first portion having a deep rim depth, a second portion having a moderate rim depth, and a third portion having a shallow rim depth. For example, a plastic lid that includes a spring-loaded locking mechanism places that locking mechanism further away from the lid's top surface. Such plastic lids can have more thickness to them to provide sufficient strength. A consequence of this is that the locking mechanism will be spaced further away (i.e., deeper) into the riser than thinner lids made from other materials, such as iron. This means that a deeper rim within the opening of the riser is necessary to engage the locking mechanism of a thicker lid.

With respect to an iron lid that includes a rotating lock, it requires the rim to engage with the latch in order to secure the lid in place as well. This requires depth within the riser, but not as much depth as required by the plastic lid. Accordingly, a portion of the modular rim includes a moderate depth (i.e., not as deep as the portion of the rim required for the spring locking mechanism of the plastic lid). Additionally, versions of the plastic lid may include one or more lid interference stops extending radially outward on the underside of the lid. A transition between the deep rim section and the moderate depth rim section on the riser may serve as an abutment that engages these stops. This further allows the plastic lid to operate as normal on this modular frame while it also has the ability to accommodate a rotating locking mechanism or worm lock of iron lids.

To that end, an alternate version of an iron lid may include a worm lock mechanism that requires an even shallower depth rim section. For this type of lid, a portion of the modular rim includes a shallow rim depth (i.e., not as deep as the moderate depth rim section) for engagement with the worm. Therefore, the modular rim, including deep, moderate, and shallow rim depth sections, can accommodate lids having these varieties of locking mechanisms. This allows an installer to use the same frame for any of these lids instead of either stocking different frames or having to get a specific frame to match a particular lid.

A perspective view of a modular pit frame 2 is shown in FIG. 1. Modular pit frame 2 includes a riser 4 extending from a collar 6. Riser 4 defines a central opening 8 that allows access to a pit or tile that modular pit frame 2 sits on top of (see, also, FIGS. 3 and 4). The top edge of riser 4 forms a rim 10 that supports different rim sections. For example, rim section 12 is composed of a deep rim wall 14 extending from the inner periphery of rim 10 to deep edge 16. Rim section 18 is composed of a moderate depth rim wall 20 extending to a moderate depth edge 22. The difference in depths between rim section 12 and rim section 18 is further accentuated by transition 24 between the two rim sections. Rim section 26 includes a shallow wall 28 that extends from rim 10 to a shallow edge 30. Another transition 32 is located between rim section 18 and rim section 26 as illustratively shown. Each of rim sections 12, 18, and 26 are different depths within central opening 8 to accommodate different lids. By accommodating these different lids, there is no need for different pit or tile frames to be matched with each different lid. Modular pit frame 2 is all that is needed to accommodate the variety of lids. Further shown on rim 10 is various indicia 34, 36, and 38, which indicate where on riser 4 the lock assembly of the lid should be aligned in order to secure to modular pit frame 2. A plurality of braces 40 are shown extending between riser 4 and collar 6. Braces 40 create additional structural strength of modular pit frame 2, while allowing space between riser 4 and collar 6, which accommodates fill material that can be packed around riser 4 and on top of collar 6.

Figure 2:
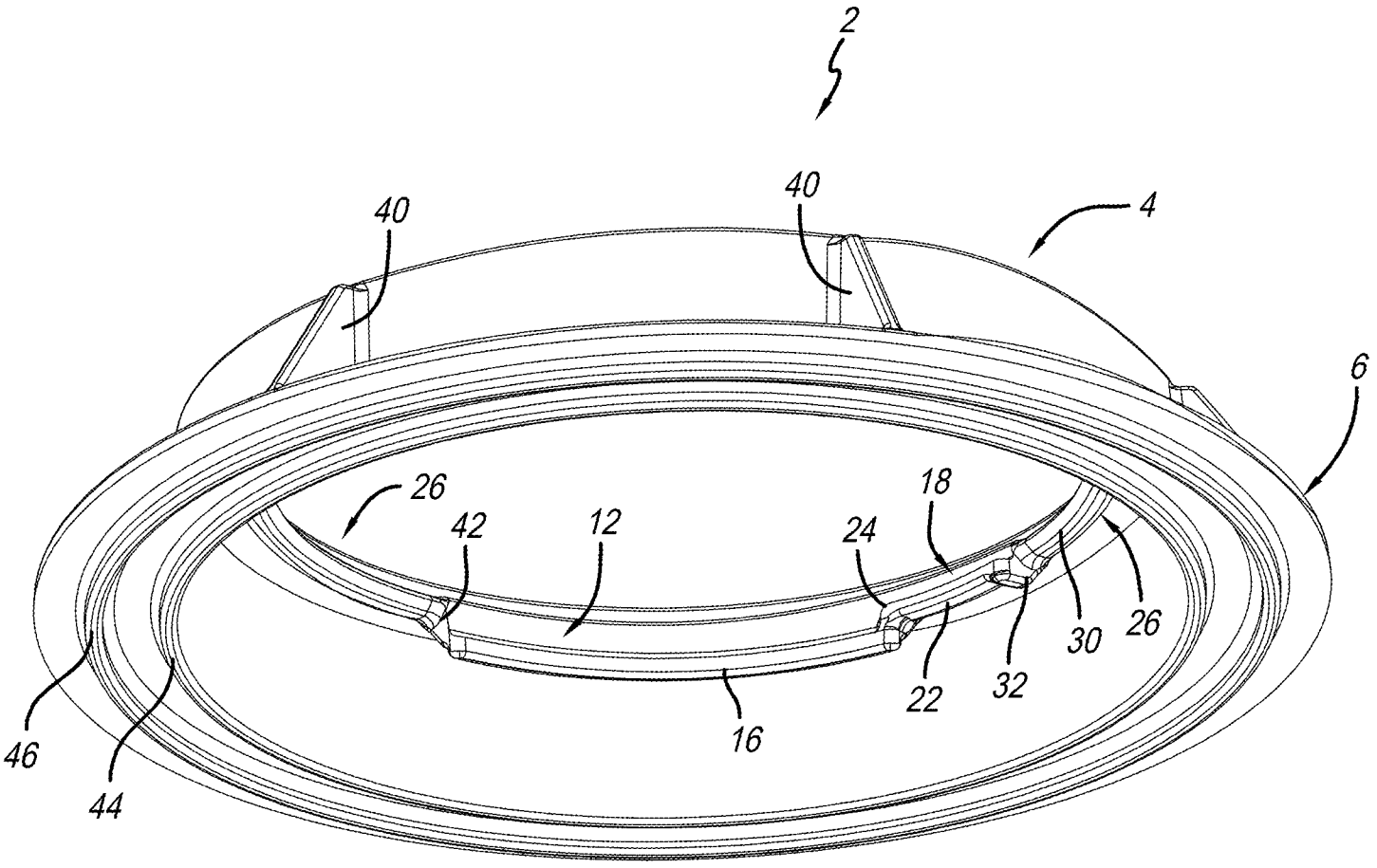
FIG. 2 is an underside perspective view of the modular pit frame.

An underside perspective view of modular pit frame 2 is shown in FIG. 2. This view also shows rim sections 12, 18, and 26. In particular, this view further illustrates the change in relative depths between the rim sections. It also highlights deep edge 16, moderate depth edge 22, and shallow edge 30, as well as transitions 24 and 32, between the rim sections. It is appreciated that rim sections 12, 18, and 26 are repeated on rim 10. Consequently, another transition 42, which is essentially a wall or stop edge, is located between another rim section 26 and rim section 12, as shown.

Also shown in this view are spaced apart guide rings 44 and 46 located on the underside of collar 6. Guide ring 44 is an inner ring located at the lower inner periphery of riser 4 while guide ring 46 is spaced apart from guide ring 44 on the underside of collar 6. This configuration accommodates different diameters of meter pits or tiles. In other words, guide rings 46 and 44 assist in positioning modular pit frame 2 onto tiles of different diameters (see, also, FIGS. 4 and 5).

Figure 3:
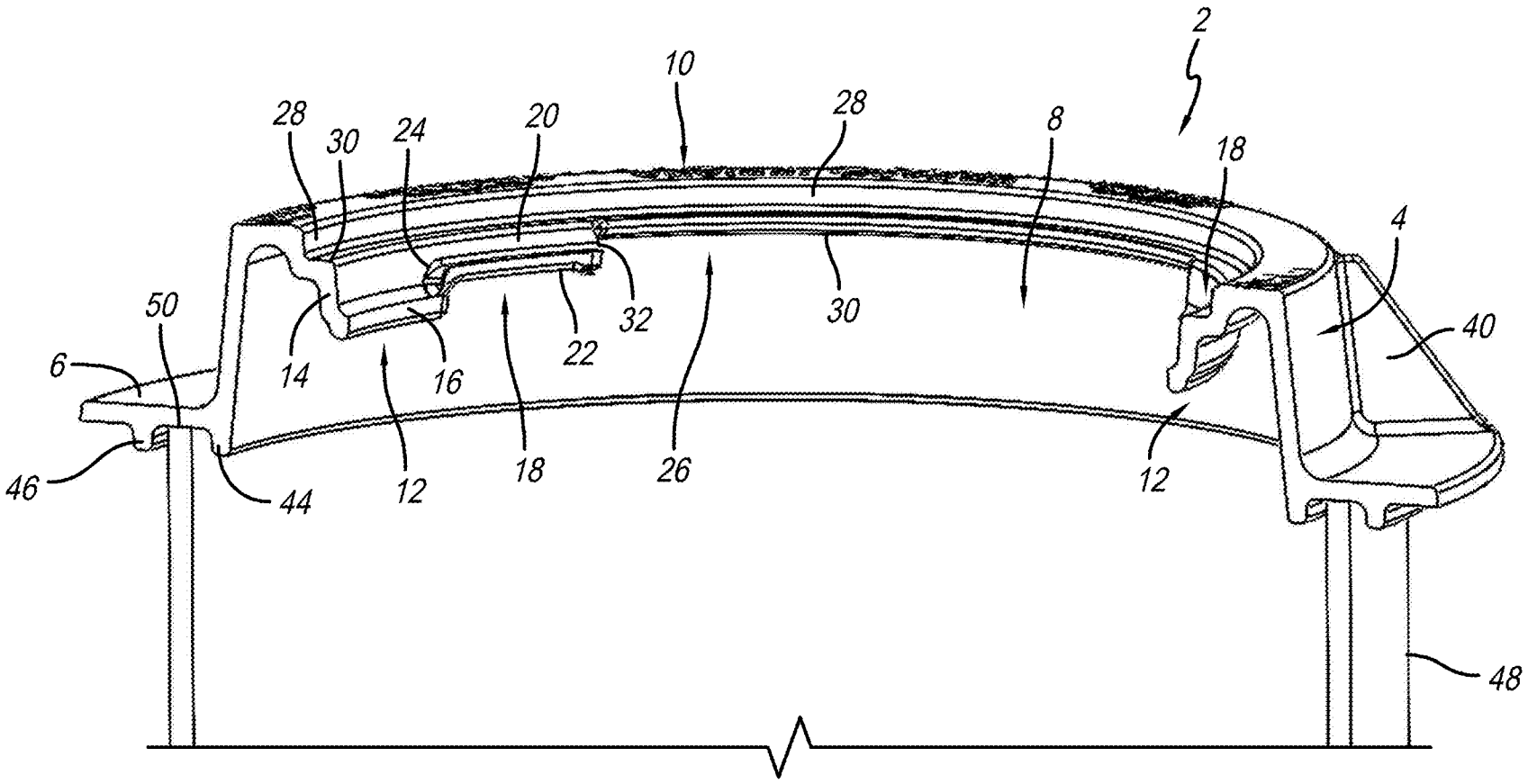
FIG. 3 is a cross-sectional perspective view of a portion of the modular pit frame seated on a pit or tile.

A cross-sectional perspective view of a portion of modular pit frame 2, seated on a pit or tile 48, is shown in FIG. 3. Illustratively, tile 48 has a 24 inch diameter. This means it can sit between guide rings 44 and 46 on the underside of collar 6. It is appreciated how guide rings 44 and 46 can assist properly positioning modular pit frame 2 onto tile 48. For example, top edge 50 of tile 48 fits between guide rings 44 and 46 as shown.

Also shown in this view are at least portions of rim sections 12, 18, and 26 extending from rim 10 of riser 4. In particular, this view demonstrates how deep rim wall 14 actually extends downward within central opening 8 of riser 4 from shallow edge 30 and shallow wall 28, which is part of rim section 26. Such an illustrative configuration extends additional depth into central opening 8 by rim section 12. This is to provide the appropriate depth needed for deep edge 16 to engage the lock assembly of a lid.

Similarly, with respect to rim section 18, it too includes its moderate depth wall 20 extending from shallow edge 30 and shallow wall 28 of rim section 26. This view also shows moderate depth edge 22 located between transition 24 and transition 32. Rim section 26 is shown, including shallow wall 28 extending from rim 10, and leading to shallow edge 30. In an illustrative embodiment, shallow wall 28 and shallow edge 30 encircle the inner periphery of rim 10 of riser 4. This view also demonstrates how rim section 18 and rim section 12 repeat themselves opposite each other on rim 10 (see, also, FIG. 6).

Figure 4:
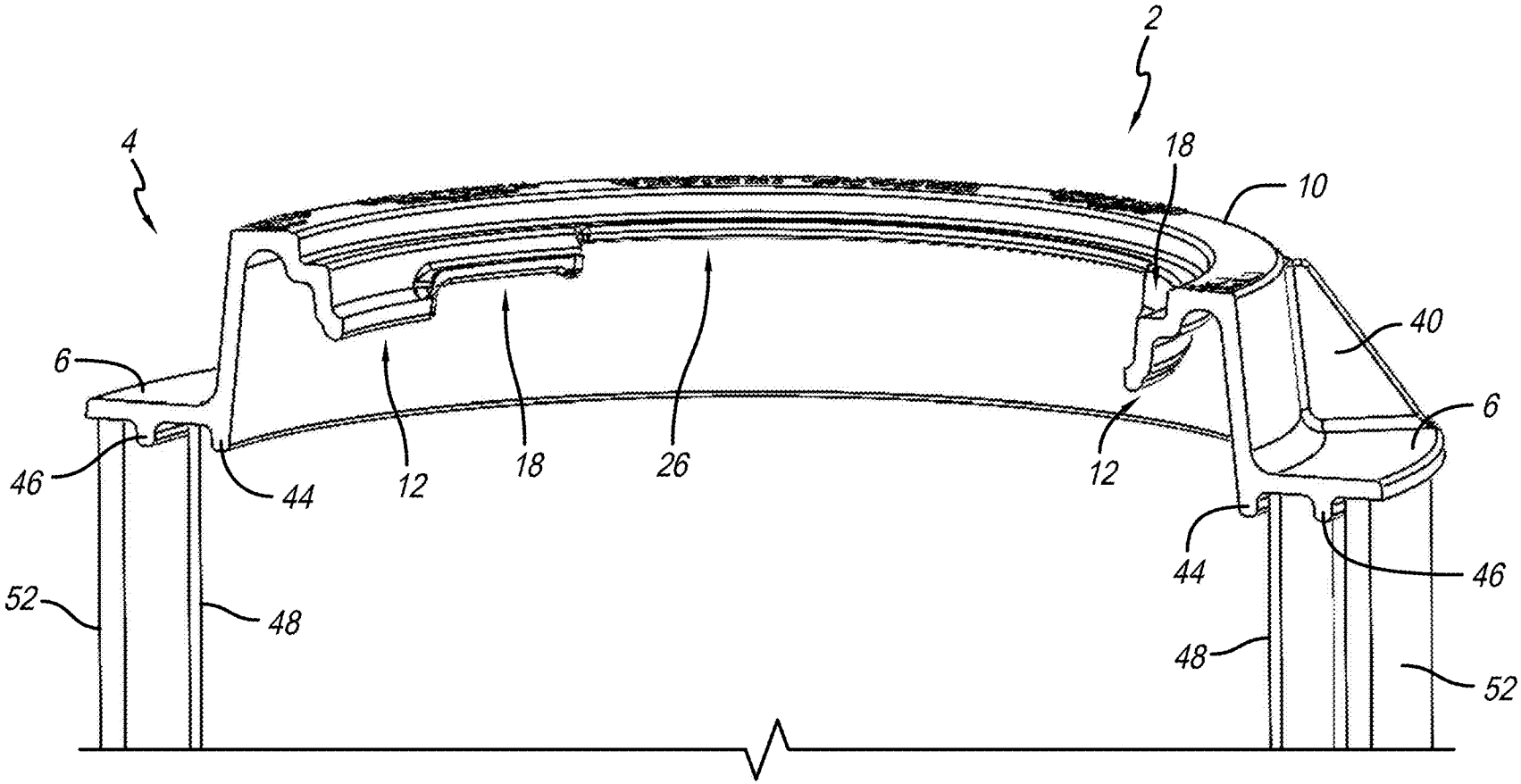
FIG. 4 is a cross-sectional perspective view of the modular pit frame seated on multiple tiles of different diameter.

Another cross-sectional perspective view of modular pit frame 2, this time seated on both tile 48 and tile 52, is shown in FIG. 4. Illustratively, tile 48 may be a 24 inch tile seated between guide rings 44 and 46, as previously discussed, whereas, tile 52 may be a 27 inch diameter tile seated exterior of guide ring 46, but still on the underside of collar 6. It will be appreciated by the skilled artisan upon reading this disclosure that this view is not necessarily demonstrating that multiple pit tiles, such as tiles 48 and 52, are to be nested within each other as shown. Rather, this view is demonstrative of how different diameters of tiles can be accommodated using the same modular pit frame 2.

Figure 5:
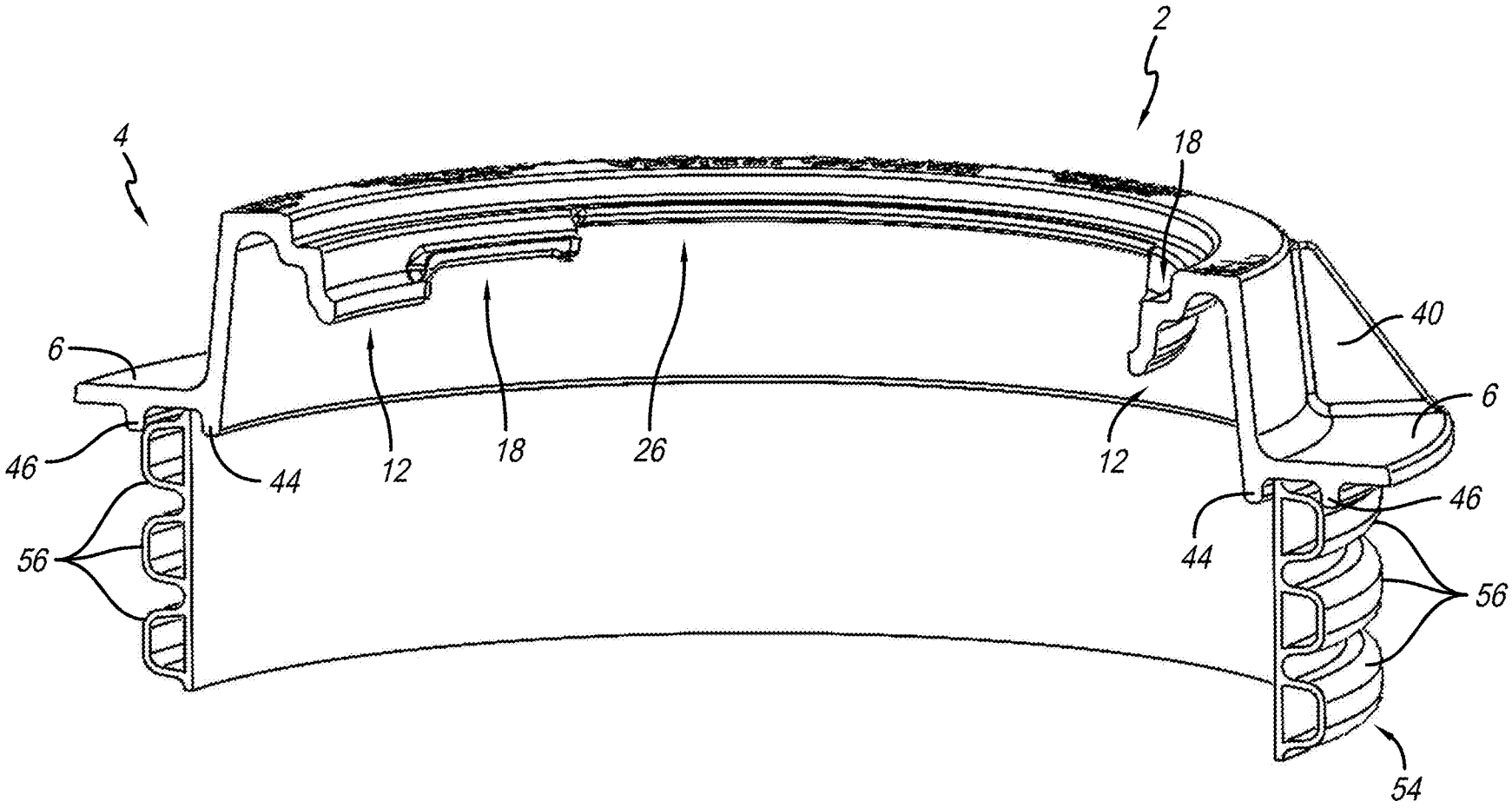
FIG. 5 is a perspective cutaway view of the modular pit frame sitting on a corrugated tile.

Another perspective cutaway view of modular pit frame 2, this time sitting on a corrugated tile 54, is shown in FIG. 5. Here, because corrugated tile 54 includes rib members 56, such may be fitted between spaced apart guide rings 44 and 46 extending from the underside of collar 6, as shown. Again, guide rings 44 and 46 being spaced apart from each other serve as a guide so modular pit frame 2 fits properly onto corrugated tile 54. This view also shows rim sections 12, 18, and 26 like that of FIGS. 3 and 4.

Figure 6:
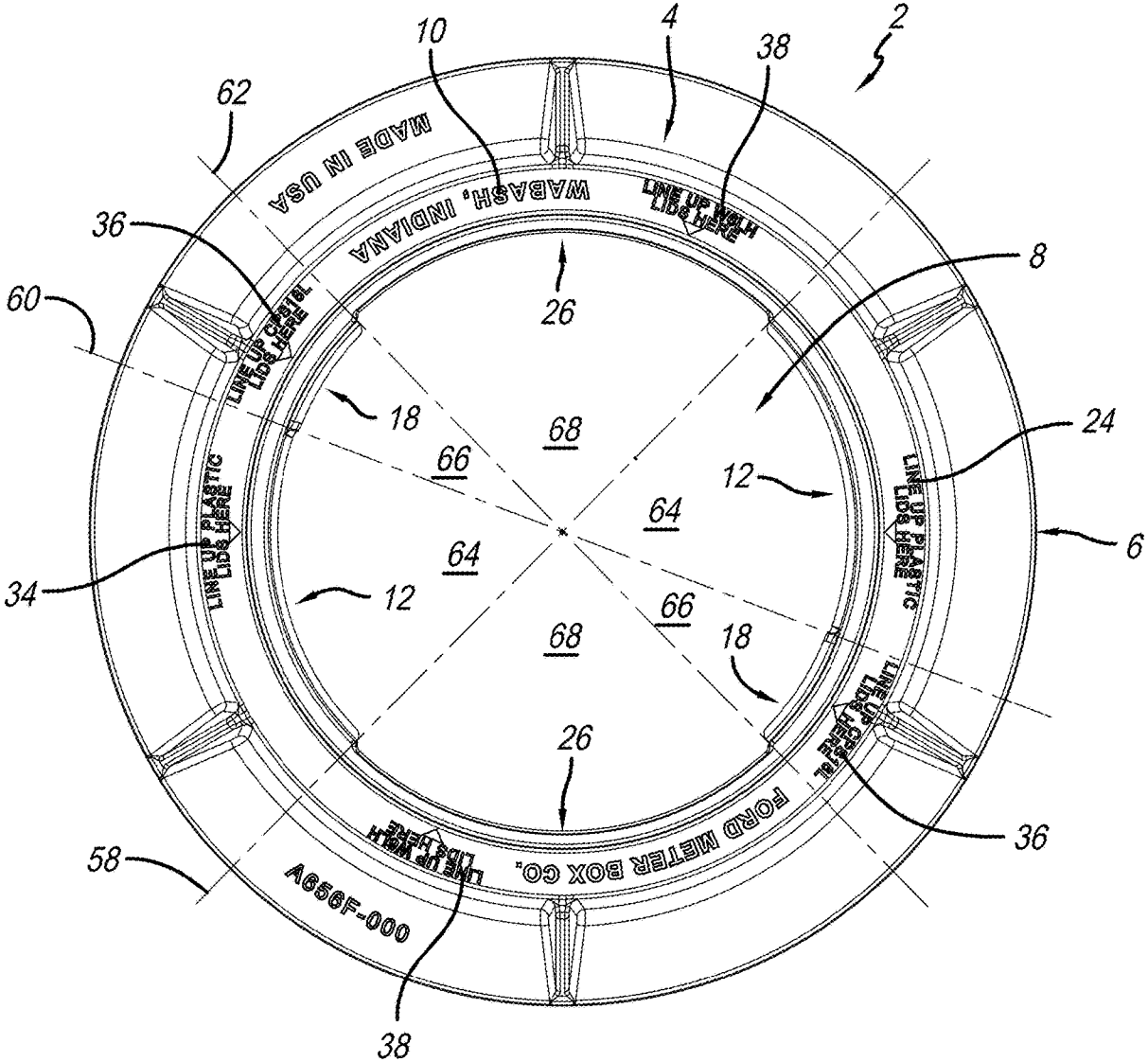
FIG. 6 is a top view of the modular pit frame.
Figure 7:
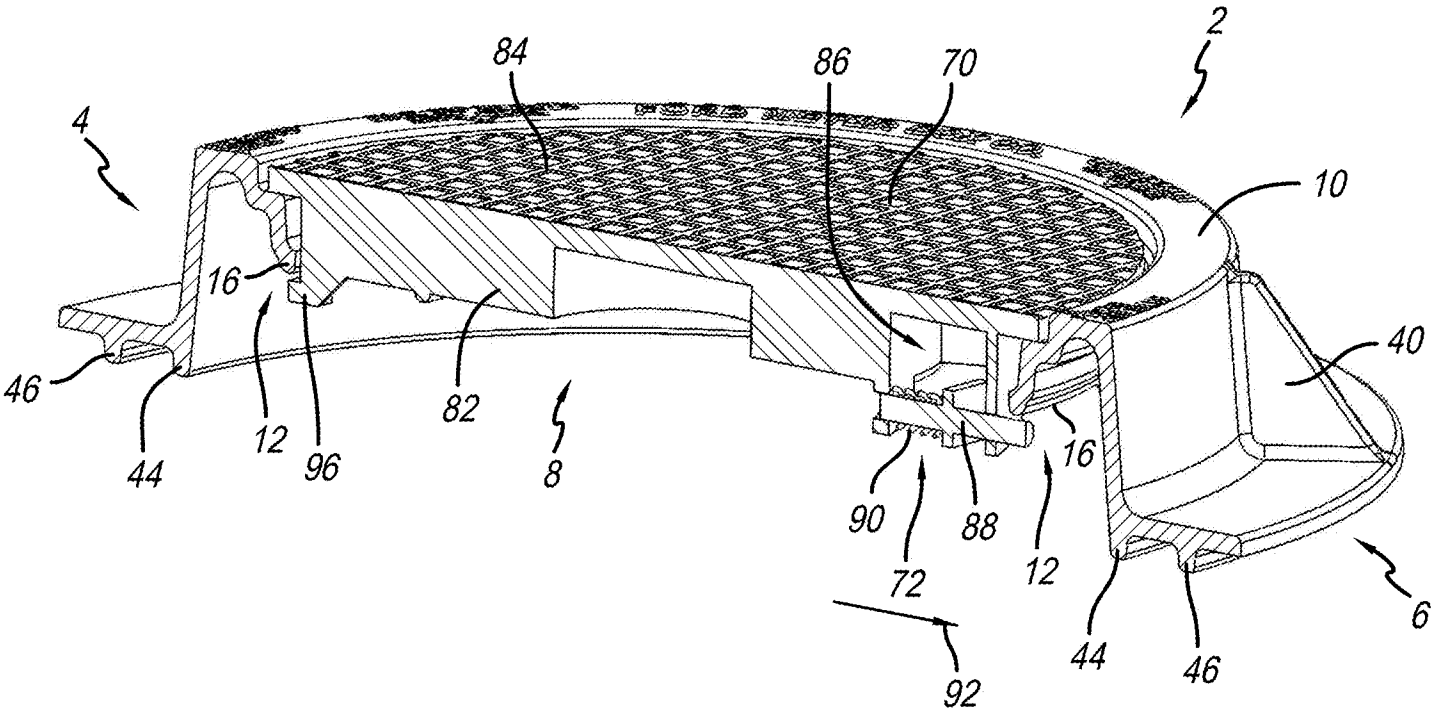
FIG. 7 is a cross-sectional perspective view of a portion of the modular pit frame with a corresponding portion of a lid located thereon.
Figure 10:
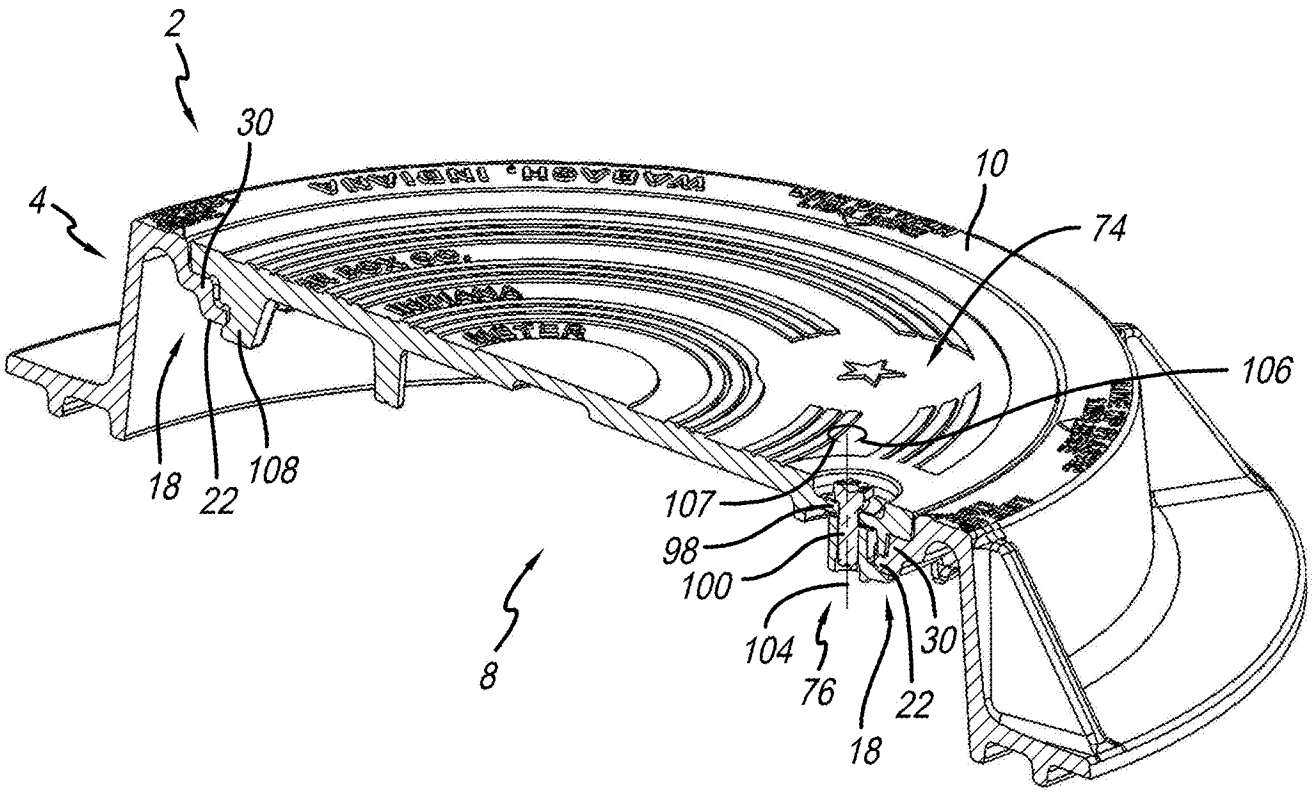
FIG. 10 is a cross-sectional perspective view of a portion of the modular pit frame with a corresponding portion of the lid located thereon.

A top view of modular pit frame 2 is shown in FIG. 6. This view depicts how multiple rim sections 12, 18, and 26 oppose each other to assist in easy installation for one of a variety of lids. Illustrative ghost lines 58, 60, and 62 segregate different rim sections 12, 18, and 26 into corresponding quadrants 64, 66, and 68. Each of quadrants 64, 66, and 68 include portions of riser 4 that can correspond with the lock mechanism of a different lid. For example, a first type of lid, such as plastic lid 70 with a spring lock 72, as shown in FIG. 7, can be placed within central opening 8 such that spring lock 72 is positioned within either of quadrants 64 so as to engage rim section 12. In contrast, lid 74, with rotating lock 76, as shown in FIG. 10, which is a different configuration from spring lock 72, requires a different rim configuration as well. Thus, placing lid 74 so that rotating lock 76 is positioned within either of quadrants 66 in central opening 8 of riser 4 allows rotating lock 76 to engage rim section 18 on either side of rim 10, as shown in FIG. 6. Similarly, a lid, such as lid 78, having worm lock 80 located underneath, requires a shallower rim configuration to secure to. In this case, placing worm lock 80 in either of quadrants 68 allows worm lock 80 to engage rim section 26 and secure lid 78 to riser 4. Accordingly, aligning different lock mechanisms from different types of lids to particular positions within central opening 8 of rim 10 of riser 4 allows any of those lids to effectively secure thereto, without having to obtain a new pit frame for each different type of lid. This view also shows that different indicia 34, 36, and 38 can be placed on rim 10 to coincide with quadrants 64, 66, and 68, respectively, to guide the user where to place the particular lock mechanism suited for the particular rim section and assist in installing the lid.

A cross-sectional perspective view of a portion of modular pit frame 2, with a corresponding portion of lid 70, is shown in FIG. 7. This view demonstrates how spring lock 72 engages rim section 12 in order to secure lid 70 to riser 4 of modular pit frame 2. As shown herein, lid 70, when made of plastic or other like material, may have an increased thickness as indicated by material 82 extending within central opening 8 under top surface 84. As also shown, cavity 86 receives a portion of plunger 88 biased by spring 90 in direction 92. Plunger 88 is shown engaging the underside of deep edge 16 of rim section 12. This prevents lid 70 from being removed from riser 4 until plunger 88 is moved against the bias of spring 90 and removed from underneath deep edge 16. Opposite spring-lock 72 is hook 96 engaging deep edge 16 of rim section 12. This assists in holding lid 70 in place while plunger 88 is located under deep edge 16, as well. The combination of hook 96 and spring-lock 72 ensures lid 70 is secured onto riser 4.

Figure 8:
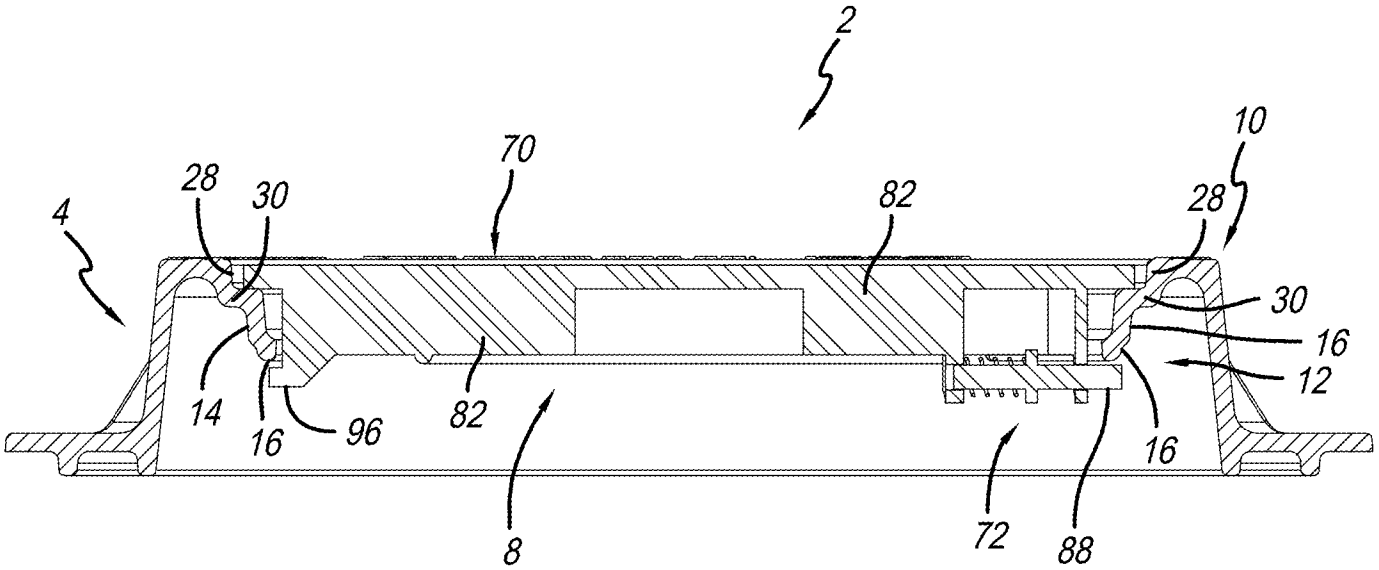
FIG. 8 is a side elevational cross-sectional view of the modular pit frame with a lid secured to the rim and a spring lock and hook.

A side elevational cross-sectional view of modular pit frame 2, with lid 70 secured to rim 10, with spring lock 72 and hook 96, is shown in FIG. 8. This view further shows a portion of plunger 88 located underneath deep edge 16 for purposes of securing lid 70 to riser 4. Because of material 82, when plastic or other lightweight material, is used for lid 70, more such material is needed. A consequence of that is material 82 creates a thicker lid that extends further into central opening 8 of riser 4. This, in turn, requires the locking mechanism, such as spring lock 72, to be lower within central opening 8, as well. Accordingly, rim section 12 includes deep rim wall 14 extending from shallow edge 30 and shallow wall 28 to provide sufficient depth for deep edge 16. It is appreciated, as shown herein, that a portion of lid 70 may rest on shallow edge 30 to support lid 70 while plunger 88 is located underneath deep edge 16 for purposes of securing or locking lid 70 to riser 4.

Figure 9:
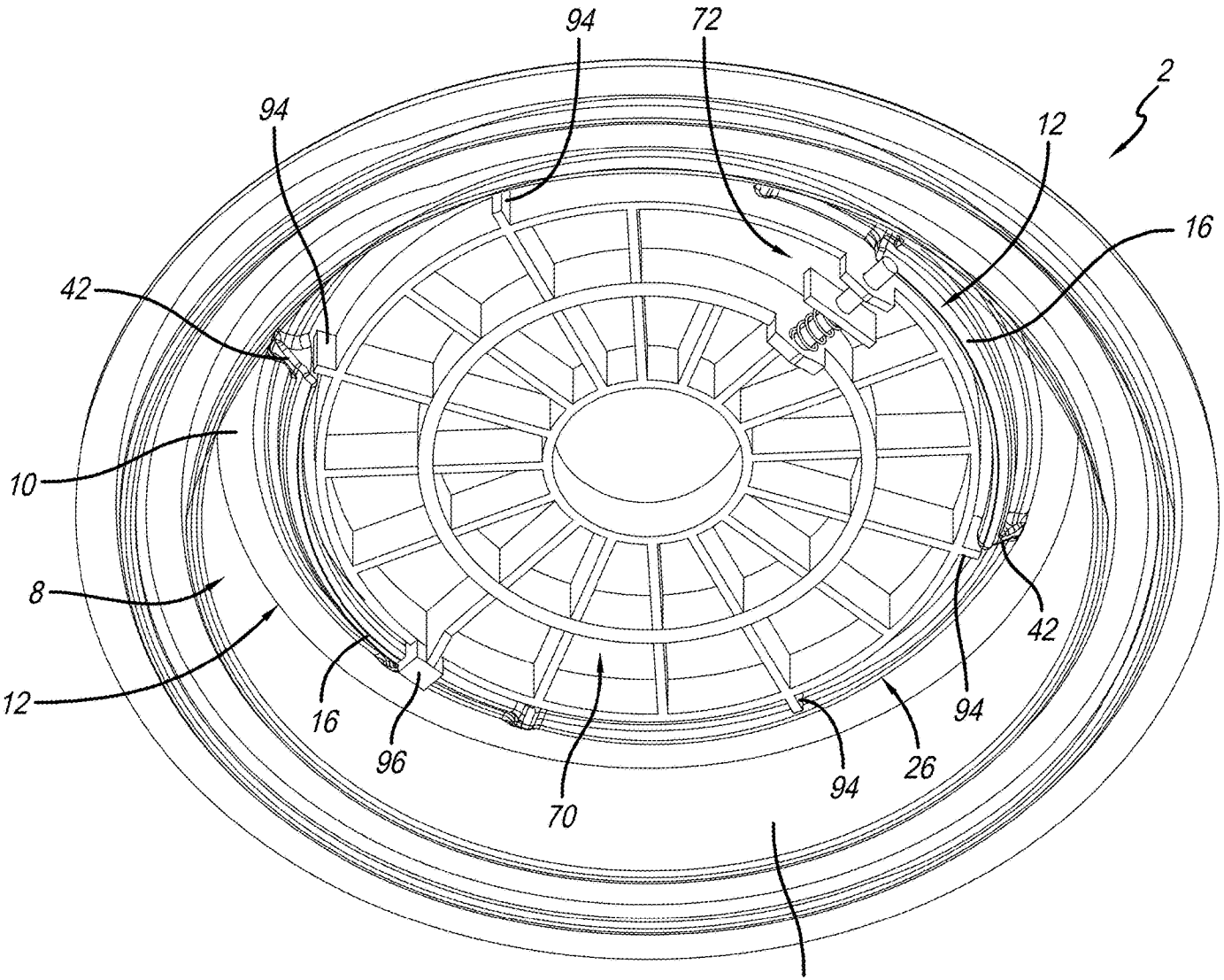
FIG. 9 is an underside perspective view of the modular pit frame with a lid set thereon.

An underside perspective view of modular pit frame 2, with lid 70 set thereon, is shown in FIG. 9. This view depicts a particular characteristic of plastic lids, such as lid 70, which is the presence of fins 94 extending laterally on the underside of lid 70 within central opening 8 of riser 4. Fins 94 limit rotational movement of lid 70 once positioned properly within riser 4 so that spring lock 72 is positioned to engage rim section 12 (see, also, FIG. 8). Here, fins 94 can engage transition 42 between rim sections 12 and 26 on each side of rim 10 (see, also, FIGS. 1 and 2). This allows transitions between rim sections, particularly, transition 42 between rim sections 12 and 26, to serve the dual purpose of providing material for changing the relative rim section heights to accommodate different lids. It also serves as an abutment or stop for fins or other protrusions like fins 94 shown herein.

Such lids, like lid 70, may also include a hook located opposite the lock mechanism in order to help secure the lid to the frame. In the illustrative case here, a hook 96 is shown engaging deep edge 16 of rim section 12. Hook 96 is opposed to spring lock 72 engaging deep edge 16 on the opposing rim section 12 to assist holding lid 70 in place.

A cross-sectional perspective view of a portion of modular pit frame 2, with a corresponding portion of lid 74, is shown in FIG. 10. This view demonstrates how rotating lock 76 engages rim section 18 for purposes of securing lid 74 to riser 4 of modular pit frame 2. In this case, a bore 98 is disposed through lid 74, which receives pin 100 that is attached to and rotates latch 102 about the central axis of pin 100. As shown, pin 100 includes axis 104 upon which pin 100 can be rotated in directions 106 or 107 to latch or unlatch latch 102 of rotating lock 76. Moderate depth edge 22 serves as the surface upon which latch 102 engages to lock lid 74 to rim 10 of riser 4. Opposite rotating lock 76 is a hook 108 that is configured to engage moderate depth edge 22 of rim section 18 opposite rim section 18 that engages rotating lock 76. This, similar to that described with respect to hook 96 of lid 70, keeps lid 74 secure in place until rotating lock 76 disengages latch 102 from moderate depth edge 22. It is appreciated that lid 74 may set on top of shallow edge 30 that encircles an inner periphery of rim 10. It is further appreciated that the other rim sections 12 and 26 do not interfere with the ability of lid 74 with rotating lock 76 to fit onto rim 10 and secure to riser 4.

Figure 11:
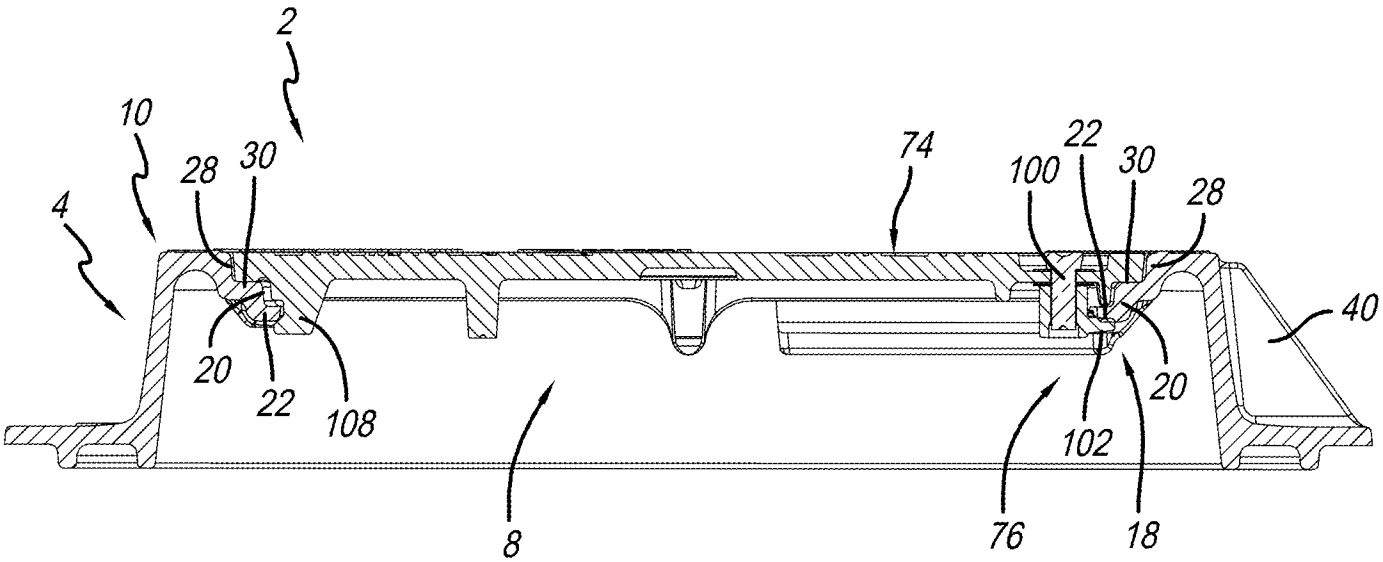
FIG. 11 is a side elevational cross-sectional view of the modular pit frame and lid secured thereon.

A side elevational cross-sectional view of modular pit frame 2, with lid 74 secured thereupon, is shown in FIG. 11. This view, similar to that of FIG. 8, further shows a portion of pin 100 extending through lid 74 and engaging latch 102, forming rotating lock 76, which engages moderate depth edge 22 securing lid 74 to riser 4. In contrast to lid 70, lid 74 may be made of a cast iron or other like material and, therefore, not require as full a depth within central opening 8 as is required by lid 70. Thus, lid 74 is engageable with rim 10 of riser 4 at a shallower depth than was required for lid 70. Rim section 18, with moderate depth rim wall 20 and moderate depth edge 22, extends less into central opening 8 than deep rim wall 14 and deep edge 16. By placing rotating lock 76 of lid 74 over quadrant 66 of rim 10 (see, also, FIG. 6), lid 74 will align properly with rim section 18 so rotating lock 76 will be engageable with moderate depth edge 22.

Like that discussed with respect to rim section 12, moderate depth rim wall 20 extends from shallow edge 30 and shallow wall 28 to provide sufficient depth for moderate depth edge 22. Like lid 70, lid 74 may set on shallow edge 30, while rotating lock 76 is engageable with moderate depth edge 22. Also shown in this view is hook 108 that engages moderate depth edge 22, but at the opposing rim section 18 of quadrant 66 (see, also, FIG. 6). Engagement between moderate depth edges 22 and hook 108/latch 102, respectively, secures lid 74 to riser 4 until rotating pin 100 disengages latch 102 from moderate depth edge 22.

Figure 12:
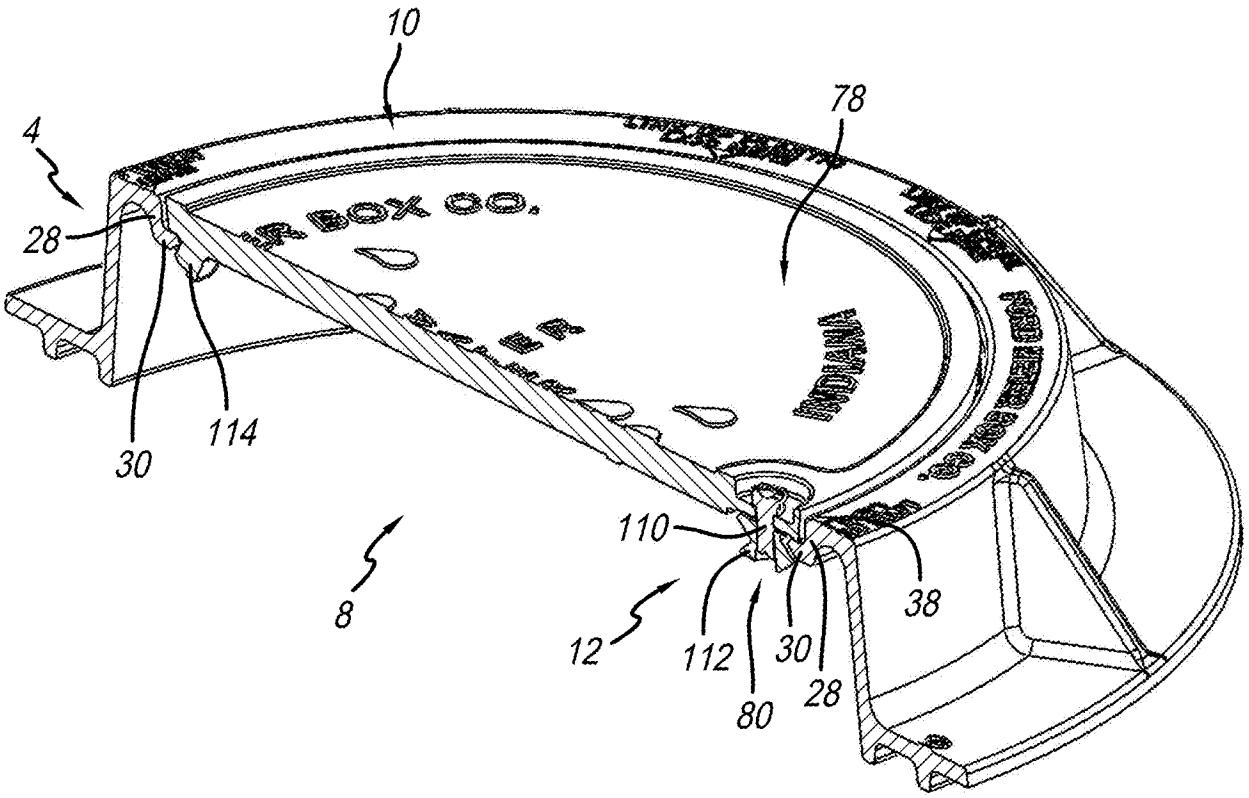
FIG. 12 is a cross-sectional perspective view of a portion of the modular frame with the corresponding portion of the lid located thereon.

Another cross-sectional perspective view of a portion of modular pit frame 2, with a corresponding portion of lid 78, is shown in FIG. 12. Unlike lids 70 and 74, lid 78 includes worm lock 80. This is a shorter locking-type assembly than either rotating lock 76 or spring lock 72. With respect to worm lock 80, a pin 110 extends through lid 78. A worm 112 fits about pin 110 and is movable therewith. An angled surface of worm 112 is engageable with shallow edge 30 extending from shallow wall 28 of rim section 12. Employing worm lock 80 requires even less depth on rim 10 than does rotating lock 76. As a consequence, rim section 26 requires even less depth than rim section 18. Hence, rim section 26 includes shallow wall 28 and shallow edge 30. Lid 74, thus, sets on shallow edge 30 similar to that described with respect to lids 70 and 74. In this case, however, because of the shallow nature of worm lock 80, it engages shallow edge 30 for securing lid 78 to riser 4. To that end, aligning worm lock 80 within quadrant 68 of rim 10 (see, also, FIG. 6) ensures proper alignment with shallow edge 30 of rim section 26. Also consistent with the other lids, is hook 114 located on the underside of lid 78 opposite worm lock 80. Hook 114 also engages shallow edge 30 so there is axial coupling between rim 10 and lid 78 for keeping same secured to riser 4 when worm lock 80 is engaged.

It is further appreciated that positioning worm lock 80 within quadrant 68 to ensure proper coupling between shallow edge 30 and lid 78 can be aided by indicia 38 located on the edge of rim 10 (see, also, FIG. 6). By aligning worm lock 80 with indicia 38, worm lock 80 will be sufficiently located within quadrant 68. This is the same with respect to lids 70 and 74. Aligning spring lock 72 of lid 70 with indicia 34 (see FIG. 6) ensures that spring lock 72 is within quadrant 64 so as to engage deep edge 16. Similarly, with respect to lid 74, aligning rotating lock 76 with indicia 36 (see FIG. 6), when positioning within rim 10, ensures rotating lock 76 is in quadrant 66 for proper engagement with moderate depth edge 22.

Figure 13:
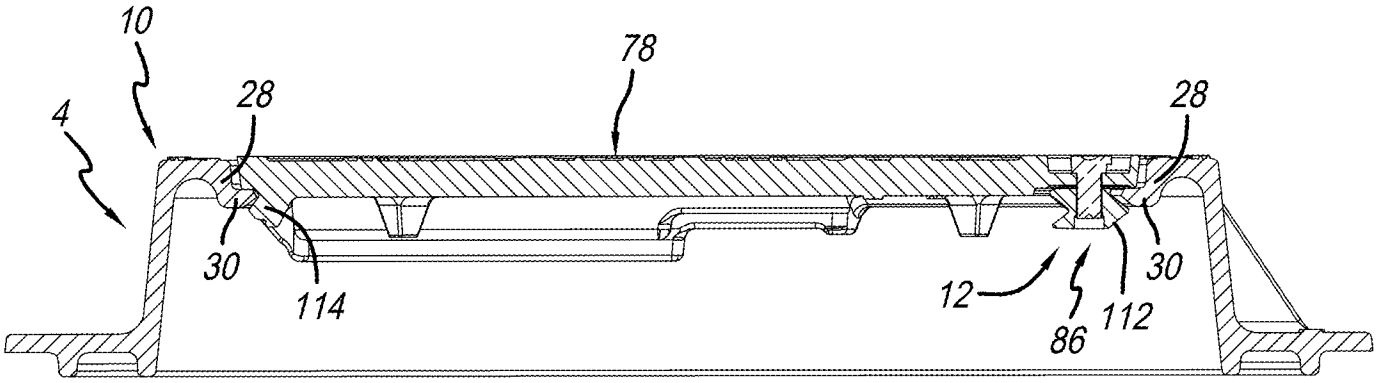
FIG. 13 is a side elevational cross-sectional view of the modular pit frame with the lid secured to the rim via a worm lock.

A side elevational cross-sectional view of modular pit frame 2, with lid 78 secured to rim 10, via worm lock 80, is shown in FIG. 13. This view further demonstrates how worm 112 engages shallow edge 30 extending from shallow wall 28 of rim section 12. It is appreciated that lid 78 may be made of cast iron or other like material similar to lid 74. Also shown in this view is hook 114, which also engages shallow edge 30, but opposite worm lock 80. Thus, like the other lids 70 and 74, lid 78 can be removably latched to shallow edge 30, and, thus, rim 10. Only by rotating worm 112 until it clears shallow edge 30 can lid 78 be properly removed.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features. It should also be appreciated that any subject matter disclosed in this non-provisional patent application that may differ from the priority application, the disclosure from this non-provisional patent application controls.

What is claimed:

1. A modular pit frame, configured to receive a lid made to fit over a tile and has one of a plurality of lid types, the modular pit frame comprising:
- a riser;
- wherein the riser includes a central circular opening bordered by a modular rim that includes a plurality of rim sections;
- wherein each of the plurality of rim sections is configured to accommodate a lid type of the plurality of lid types;
- a collar extending from the riser;
- wherein the collar is configured to be supported by the tile;
- wherein the plurality of rim sections includes a first rim section, a second rim section, and a third rim section;
- wherein the first rim section includes a first rim wall that depends into the central circular opening and forms a first portion of a periphery of the central circular opening;
- wherein the first rim section includes a first rim edge that extends transverse to the first rim wall into the central circular opening;
- wherein the second rim section includes a second rim wall that depends into the central circular opening and forms a second portion of the periphery of the central circular opening;
- wherein the second rim wall depends further into the central circular opening than the first rim wall;
- wherein the second rim section includes a second rim edge that extends transverse to the second rim wall into the central circular opening;
- wherein the third rim section includes a third rim wall that depends into the central circular opening and forms a third portion of the periphery of the central circular opening;
- wherein the third rim wall depends further into the central circular opening than the first rim wall and the second rim wall;
- wherein the third rim section includes a third rim edge that extends transverse to the third rim wall into the central circular opening;
- a first transition surface located adjacent the first rim section and the second rim section; and
- a second transition surface located adjacent the second rim section and the third rim section.

2. The modular pit frame of claim 1, wherein the first transition surface is oriented transverse to the second rim section.

3. The modular pit frame of claim 1, wherein the second transition surface is oriented transverse the third rim section.

4. The modular pit frame of claim 1, wherein the first rim wall of the first rim section extends around an entire circumference of the central circular opening.

5. The modular pit frame of claim 1, further comprising a fourth rim section that includes a fourth rim wall that depends into the central circular opening and forms a fourth portion of the periphery of the central circular opening, wherein the fourth rim wall depends further into the central circular opening than the first rim wall, and wherein the fourth rim section includes a fourth rim edge that extends transverse to the fourth rim wall into the central circular opening.

6. The modular pit frame of claim 5, further comprising a fifth rim section that includes a fifth rim wall that depends into the central circular opening and forms a fifth portion of the periphery of the central circular opening, wherein the fifth rim wall depends further into the central circular opening than the fourth rim wall, and wherein the fifth rim section includes a fifth rim edge that extends transverse to the fifth rim wall into the central circular opening.

7. The modular pit frame of claim 6, wherein the fourth rim section is located on the collar opposite the second rim section.

8. The modular pit frame of claim 6, wherein the fifth rim section is located on the collar opposite the third rim section.

9. The modular pit frame of claim 8, wherein the first rim wall of the first rim section extends around an entire circumference of the central circular opening which includes between the second rim section and the fifth rim section as well as the third rim section and forth rim section.

10. The modular pit frame of claim 9, wherein the second rim section is located adjacent the third rim section and the fourth rim section is located adjacent the fifth rim section.

11. The modular pit frame of claim 1, further comprising a first indicia located adjacent the first rim section, a second indicia located adjacent the second rim section, and a third indicia located adjacent the third rim section.

12. The modular pit frame of claim 1, further comprising one or more braces extending between the riser and the collar.

13. The modular pit frame of claim 1, further comprising a third transition surface located adjacent the third rim section and the first rim section.

14. The modular pit frame of claim 1, further comprising at least one guide ring located on an underside of the riser opposite the collar, wherein the at least one guide ring is configured to be located adjacent a top edge of the tile.

15. The modular pit frame of claim 1, further comprising a plurality of guide rings spaced apart from each other, wherein each of the plurality of guide rings is located on an underside of the riser opposite the collar.

16. A modular pit frame, configured to receive a lid made to fit over a tile and has one of a plurality of lid types, the modular pit frame comprising:

a riser;

wherein the riser includes an opening bordered by a modular rim that includes a plurality of rim sections;

wherein each of the plurality of rim sections is configured to accommodate a lid type of the plurality of lid types;

a collar extending from the riser;

wherein the collar is configured to be supported by the tile;

wherein the plurality of rim sections includes a first rim section, a second rim section, and a third rim section;

wherein the first rim section includes a first rim wall that depends into the opening and forms a first portion of a periphery of the opening;

wherein the second rim section includes a second rim wall that depends into the opening and forms a second portion of the periphery of the opening;

wherein the second rim wall depends further into the opening than the first rim wall;

wherein the third rim section includes a third rim wall that depends into the opening and forms a third portion of the periphery of the opening; and wherein the third rim wall depends further into the opening than the first rim wall and the second rim wall.

17. The modular pit frame of claim 16, wherein the opening of the riser is circular.

18. The modular pit frame of claim 16, wherein the first rim section includes a first rim edge that extends transverse to the first rim wall into the opening, the second rim section includes a second rim edge that extends transverse to the second rim wall into the opening, and the third rim section includes a third rim edge that extends transverse to the third rim wall into the opening.

19. The modular pit frame of claim 16, further comprising a first transition surface located adjacent the first rim section and the second rim section and a second transition surface located adjacent the second rim section and the third rim section.

20. A modular pit frame, configured to receive a lid made to fit over a tile and has one of a plurality of lid types, the modular pit frame comprising:

a riser;

wherein the riser includes an opening bordered by a modular rim that includes a plurality of rim sections;

wherein each of the plurality of rim sections is configured to accommodate a lid type of the plurality of lid types;

wherein the plurality of rim sections includes a first rim section, a second rim section, and a third rim section;

wherein the first rim section includes a first rim wall that depends into the opening and forms a first portion of a periphery of the opening;

wherein the second rim section includes a second rim wall that depends into the opening and forms a second portion of the periphery of the opening; and wherein the second rim wall depends further into the opening than the first rim wall.

* * * * *